US009179233B2

(12) United States Patent
Kang

(10) Patent No.: US 9,179,233 B2
(45) Date of Patent: Nov. 3, 2015

(54) APPARATUS AND METHOD FOR INTERFACING EARPHONE

(71) Applicant: Samsung Electronics Co., Ltd., Gyeonggi-do (KR)

(72) Inventor: Seong-Geun Kang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 279 days.

(21) Appl. No.: 13/779,241

(22) Filed: Feb. 27, 2013

(65) Prior Publication Data

US 2013/0259246 A1 Oct. 3, 2013

(30) Foreign Application Priority Data

Mar. 30, 2012 (KR) ..... 10-2012-0033388

(51) Int. Cl.
*H04R 29/00* (2006.01)
*H04R 1/10* (2006.01)
*H04R 5/04* (2006.01)

(52) U.S. Cl.
CPC ..... *H04R 29/001* (2013.01); *H04R 1/1041* (2013.01); *H04R 5/04* (2013.01)

(58) Field of Classification Search
CPC ..... H02R 2430/01; H02R 3/00; H02R 5/04; H02R 1/10; H02R 1/1041; H02R 1/1091; H02R 2201/107; H02R 2420/03; H02R 2420/05; H02R 3/12; H02R 1/1016; H02R 1/1033; H02R 1/1058; H02R 1/1066
USPC ..... 381/74, 92, 91, 56–58, 71.1–71.6, 381/94.1–94.4; 379/430, 421–425; 455/557, 556.1, 567, 568, 569.1
See application file for complete search history.

(56) References Cited

U.S. PATENT DOCUMENTS

| | | | | |
|---|---|---|---|---|
| 7,130,184 | B2 | 10/2006 | Choi | |
| 2004/0116005 | A1 | 6/2004 | Choi | |
| 2006/0233383 | A1* | 10/2006 | Lee | 381/58 |
| 2009/0227286 | A1* | 9/2009 | Arai | 455/556.1 |
| 2010/0272252 | A1* | 10/2010 | Johnson et al. | 379/430 |
| 2010/0303251 | A1 | 12/2010 | Im et al. | |
| 2010/0303255 | A1* | 12/2010 | Im et al. | 381/94.1 |
| 2011/0091063 | A1 | 4/2011 | Lee | |
| 2012/0051562 | A1* | 3/2012 | Kim | 381/122 |
| 2012/0237051 | A1* | 9/2012 | Lee | 381/74 |

FOREIGN PATENT DOCUMENTS

| | | | |
|---|---|---|---|
| CN | 201142743 | Y | 10/2008 |
| CN | 101431708 | A | 5/2009 |
| JP | 2006-073426 | | 3/2006 |
| JP | 2006-279384 | | 10/2006 |
| KR | 10-2009-0130741 | | 12/2009 |
| KR | 10-2011-0042455 | | 4/2011 |

OTHER PUBLICATIONS

Extended European Search Report dated Jan. 30, 2014 in connection with European Application No. 13156194.6, 7 pages.
Korean Notice of Patent Grant dated Mar. 14, 2013 in connection with Korean Patent Application No. 10-2006-0125533, 6 pages.
Communication Pursuant to Article 94(3) EPC dated Jan. 23, 2015 in connection with European Patent Application No. 13156194.6; 5 pages.
First Office Action dated Jul. 24, 2015 in connection with Chinese Patent Application No. 201310104698.7; 16 pages.

* cited by examiner

*Primary Examiner* — Lun-See Lao

(57) ABSTRACT

An apparatus and method for interfacing with an earphone are provided. The method includes checking if the earphone is uninstalled promptly after the connection of the earphone is sensed in an external port and if it is sensed that the earphone is uninstalled, continuing to apply a voltage to a MIC_BIAS terminal. The generation of a noise of the MIC_BIAS terminal caused by applying of a periodic voltage resulted from loose insertion of the earphone is prevented.

20 Claims, 7 Drawing Sheets

```
<6>[ 602.059013] sec_jack: ear micbias on
<6>[ 602.060875] sec_jack: sec_jack_det_irq_handler : ready =1.
<6>[ 602.061760] sec_jack: determine_jack_type adc = 1370
<6>[ 602.081566] sec_jack: ear micbias off
<6>[ 602.081596] sec_jack: ear micbias off
<6>[ 602.081779] sec_jack: sec_jack_det_irq_handler : ready =1.
<6>[ 602.179007] sec_jack: ear micbias on
<6>[ 602.180869] sec_jack: sec_jack_det_irq_handler : ready =1.
<6>[ 602.181754] sec_jack: determine_jack_type adc = 1371
<6>[ 602.201560] sec_jack: ear micbias off
<6>[ 602.201590] sec_jack: ear micbias off
<6>[ 602.201774] sec_jack: sec_jack_det_irq_handler : ready =1.
<6>[ 602.299063] sec_jack: ear micbias on
<6>[ 602.300894] sec_jack: sec_jack_det_irq_handler : ready =1.
<6>[ 602.301779] sec_jack: determine_jack_type adc = 1372
<6>[ 602.321554] sec_jack: ear micbias off
```

FIG.6A

```
<6>[ 1948.315816] sec_jack: sec_jack_det_irq_handler : ready =1.
<4>[ 1948.315907] EAR_DET = 1EAR_KEY_INT=1
<4>[ 1948.315938] calling Handler Work function
<6>[ 1948.317128] sec_jack: sec_jack_det_irq_handler : ready =1.
<4>[ 1948.317250] EAR_DET = 1EAR_KEY_INT=1
<4>[ 1948.317281] calling Handler Work function
<6>[ 1948.319844] sec_jack: sec_jack_det_irq_handler : ready =1.
<4>[ 1948.319905] EAR_DET = 0EAR_KEY_INT=1
<4>[ 1948.319966] calling Handler Work function
<6>[ 1948.320149] sec_jack: sec_jack_det_irq_handler : ready =1.
<4>[ 1948.320271] EAR_DET = 0EAR_KEY_INT=1
<4>[ 1948.320302] calling Handler Work function
<6>[ 1948.323049] sec_jack: sec_jack_det_irq_handler : ready =1.
<4>[ 1948.323140] EAR_DET = 0EAR_KEY_INT=1
<4>[ 1948.323171] calling Handler Work function
<6>[ 1948.329183] sec_jack: determine_jack_type adc = 0
```

FIG.6B

APPARATUS AND METHOD FOR INTERFACING EARPHONE

CROSS-REFERENCE TO RELATED APPLICATION(S) AND CLAIM OF PRIORITY

The present application is related to and claims priority under 35 U.S.C. §119(a) to a Korean Patent Application No. 10-2012-0033388 filed on Mar. 30, 2012 in the Korean Intellectual Property Office, the contents of which are herein incorporated by reference.

TECHNICAL FIELD OF THE INVENTION

The present disclosure relates to an apparatus and method for detecting an earphone applied to an electronic device.

BACKGROUND OF THE INVENTION

Recently, as a multimedia technology is developed, an electronic device having various functions has appeared. As these devices, for example, there is a portable terminal mainly classified into a smart phone. These devices generally have a convergence function of complexly performing one or more functions.

Particularly, a portable terminal, which is being recently launched, has a function capable of receiving airwave broadcasting (for example, terrestrial Digital Multimedia Broadcasting (DMB)) and playing back a music file or photographing and playing back a moving picture in high definition in addition to a basic calling function.

When performing these various supplementary functions, a portable terminal additionally uses an earphone device (generally, called an 'earphone') including an earplug inserted into an ear jack hole of an ear jack provided in a corresponding device. In this earphone device, an earplug is provided at one end of a cable of a predetermined length, and a pair of earphones for listening to sound in stereo is installed at the other end thereof. Also, generally, a microphone is installed in a middle of the cable to perform a hands free function upon call.

The aforementioned earplug generally uses a 3-pole or 4-pole terminal. Each terminal is installed in an electrical insulation state. If being connected to an ear jack, each terminal comes into contact with a corresponding pin installed in a corresponding location of the ear jack, whereby each terminal performs a corresponding function.

For example, in a 3.5 pie 3-pole terminal of an earplug, a first terminal of the lowest side, a 2nd terminal of the top thereof, and a 3rd terminal of the top thereof, which take charge of SPK_L, SPK_R, and GND, respectively, are electrically connected with corresponding pins of an ear jack and perform functions.

Also, in a 4-pole terminal of the earplug, a first terminal of the lowest side, a 2nd terminal of the top thereof, a 3rd terminal of the top thereof, and a 4th terminal of the top thereof are electrically connected with corresponding pins of the ear jack, which take charge of SPK_L, SPK_R, GND, and MIC, respectively, and perform functions.

An ear jack for housing an earplug as described above is of a construction of connecting corresponding terminals of the earplug correspondingly to a plurality of pins installed in different locations within one housing. This can cause a detection error problem in course of inserting the earplug into the ear jack.

For instance, a sense pin for sensing the insertion or non-insertion of the earplug is installed at a housing end of the ear jack. Although the earplug is not fully (i.e., loosely) inserted into the ear jack, if a SPK_L terminal of the earplug gets into contact with the sense pin, a portable terminal detects the insertion of an earphone. But in this case, because the earphone is inserted into the portable terminal, the portable terminal detects a low signal by the sense pin. Due to this, the portable terminal supplies a voltage to a MIC_Bias terminal in order to check the insertion or non-insertion of a microphone. But, because the MIC terminal has not been connected with a MIC pin of the ear jack, the voltage applied to the MIC_Bias terminal is floated and is again applied to the SPK_L terminal and the sense pin. Due to this, the sense pin receives a high signal applied and detects as the earplug is uninstalled. Accordingly, the portable terminal eliminates the voltage applied to the MIC_Bias terminal. Due to this, the sense pin again receives a low signal applied and detects as the earplug is again inserted.

That is, in a state where the earplug is not fully inserted into the ear jack but the SPK_L terminal comes into contact with the sense pin, the portable terminal repeatedly performs the aforementioned operation. During this process, a periodic noise of 8 Hertz (Hz) interval is generated. This not only has given a feeling of displeasure to a user but also has become the cause of erroneous operation.

SUMMARY OF THE INVENTION

To address the above-discussed deficiencies of the prior art, it is a primary object to provide an apparatus and method for interfacing with an earphone in an electronic device, when an earplug is loosely inserted into an ear jack, enabling a user to detect this and insert it completely.

Another aspect of the present disclosure is to provide an apparatus and method for interfacing with an earphone in an electronic device when an earplug has been loosely inserted into an ear jack, which remove noise generation and prevent an erroneous operation of the electronic device in advance.

A further aspect of the present disclosure is to provide an apparatus and method for interfacing an earphone in an electronic device, which notify a user of this state through a display unit of the electronic device and improve a convenience of use of the electronic device when an earplug is loosely inserted into an ear jack and a predetermined time lapses.

The above aspects are achieved by providing an apparatus and method for detecting an earphone in an electronic device.

According to one aspect of the present disclosure, an apparatus for detecting an earphone in an electronic device is provided. The apparatus includes an external port to interface with the earphone, and at least one processor for controlling to apply a voltage to a MIC_BIAS terminal if connection of the earphone to the external port is sensed, and although disconnection of the earphone is again sensed, controlling to apply and not to turn off a voltage to the MIC_BIAS terminal. The generation of a noise of the MIC_BIAS terminal caused by applying of a periodic voltage resulted from loose insertion of the earphone is prevented.

According to another aspect of the present disclosure, a method for detecting an earphone in an electronic device is provided. The method includes checking if the earphone is uninstalled promptly after the connection of the earphone is sensed in an external port and if it is sensed that the earphone is uninstalled, continuing to apply and not turning off a voltage to a MIC_BIAS terminal. The generation of a noise of the MIC_BIAS terminal caused by applying of a periodic voltage resulting from loose insertion of the earphone is prevented.

Also, an output means of an electronic device is controlled so that a user can detect the loose insertion of an earphone. For example, if the loose insertion of the earphone is sensed, the electronic device can display an error message on a display unit, and can output a sound through a sound output means such as a speaker, thereby being capable of allowing the user to be notified an error. Further, the electronic device may output the error message and the error sound together.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 6A is an exemplary normal operation code resulting from earphone detection of an electronic device according to an exemplary embodiment of the present disclosure and FIG. 6B is an exemplary erroneous operation code resulting from conventional loose insertion.

DETAILED DESCRIPTION OF THE INVENTION

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electric device. Preferred embodiments of the present disclosure will be described herein below with reference to the accompanying drawings. In the following description, well-known functions or constructions are not described in detail since they would obscure the disclosure in unnecessary detail. And, terms described below, which are defined considering functions in the present disclosure, can be different determining on user and operator's intention or practice. Therefore, the terms should be defined on the basis of the disclosure throughout this specification.

The present disclosure directs a portable terminal as an electronic device and an earphone device applied to the portable terminal. But, the present disclosure is not limited to this, and would be applicable to the electronic device, for example, various devices to which an earphone is applicable, such as a Personal Digital Assistant (PDA), a laptop computer, a smart phone, a netbook, a Mobile Internet Device (MID), a Ultra Mobile Personal Computer (UMPC), a table PC, a navigator, an MPEG audio layer 3 (MP3) player and the like.

Figure 1:
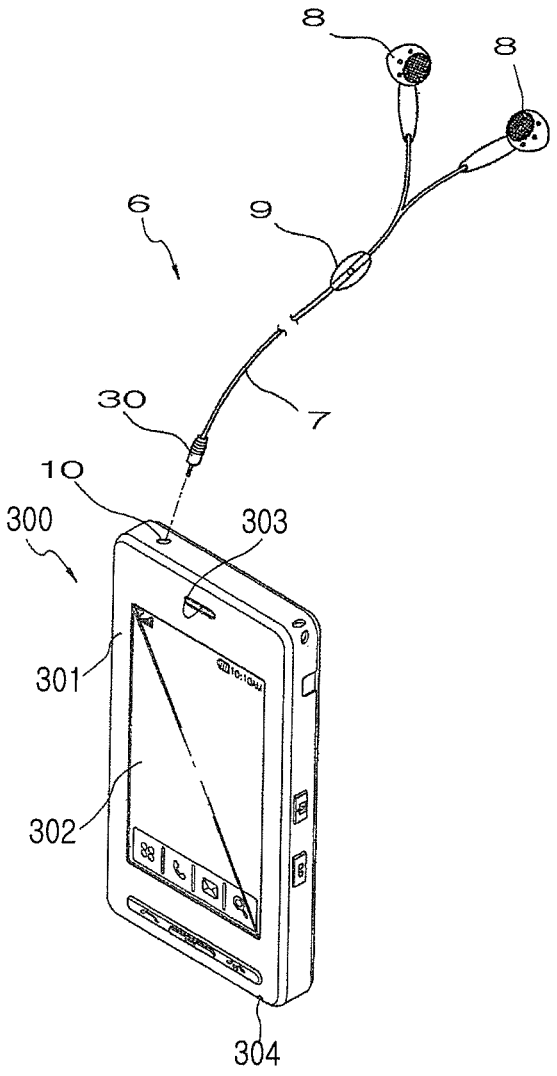
FIG. 1 is a perspective view illustrating an electronic device with an earphone detection unit according to an exemplary embodiment of the present disclosure.

FIG. 1 is a perspective view illustrating an electronic device 300 including an earphone detection apparatus according to a desirable exemplary embodiment of the present disclosure and an earphone device 6.

Referring to FIG. 1, the electronic device 300 includes a display unit 302 installed in a front surface 301, an earpiece 303 installed at a top side of the display unit 302, and a microphone 304 installed at a bottom side of the display unit 302. Also, the electronic device 300 has an ear jack 10 installed in its suitable place for receiving an earplug 30 of the earphone 6.

According to the present disclosure, when the earplug 30 of the earphone 6 is not fully inserted, i.e., is loosely inserted into the ear jack 10, if a predetermined time lapses, an error message is displayed on the display unit 302. But, the present disclosure is not limited to this, and can use a sound output means such as a speaker for generating an error sound. Alternatively, an error message and an error sound can be output simultaneously. Accordingly, a user will be able to view the error message or listen to the error sound and fully install or uninstall the earphone 6.

Also, if a predetermined time lapses after an error message is displayed or an error sound is output, the error message can be erased or the error sound output from the sound output means can be removed. Desirably, if it is sensed that the earphone is fully uninstalled from the ear jack or is fully normally inserted into the ear jack, the output of the error message or sound can be removed.

Figure 2:
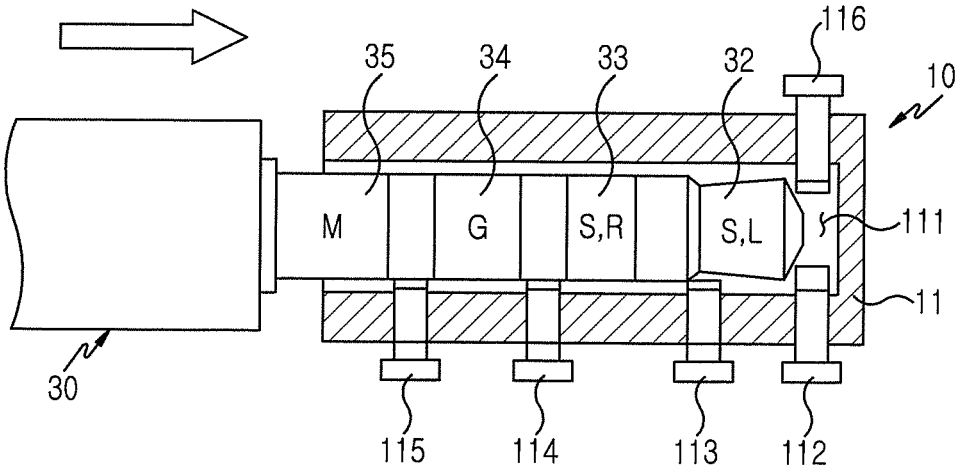
FIG. 2 is a cross-sectional diagram illustrating an earplug of an earphone loosely inserted into the ear jack of the electronic device.

FIG. 2 is a cross-sectional diagram illustrating a principal part of an ear jack 10 of an electronic device 300 and an earplug 30 of an earphone 6 loosely inserted into the ear jack 10. A 4-pole earplug is described as an example only.

Referring to FIG. 2, a first terminal 32 of the lowest side of the earplug 30, a second terminal 33 on the top thereof, a third terminal 34 on the top thereof, and a fourth terminal 35 on the top thereof correspond to SPK_L, SPK_R, GND, and MIC, respectively. The first terminal 32, the second terminal 33, the third terminal 34, and the fourth terminal 35 are arranged correspondingly to a SPK_L pin 112, a SPK_R pin 113, a GND pin 114, and a MIC pin 115 sequentially protrusively installed within a space 111 of a housing 11 constructing the ear jack 10. Accordingly, if the earplug 30 is fully inserted into the space 111 of the ear jack housing 11, the SPK_L terminal 32 of the earplug 30, the SPK_R terminal 33, the GND terminal 34, and the MIC terminal 35 are connected correspondingly to the SPK_L pin 112 of the ear jack 10, the SPK_R pin 113, the GND pin 114 and the MIC pin 115. In an exemplary embodiment, a sense pin 116, which is installed in the housing 11 of the ear jack 10, also comes into contact with the SPK_L terminal 32 and senses the insertion or non-insertion of the earphone 6.

But, although the earplug 30 is not fully inserted into the ear jack 10 of the electronic device 300 as illustrated in FIG. 2, the electronic device 300 senses a state in which the SPK_L terminal 32 is inserted and connected to the SPK_L pin 112 and the sense pin 116. In this case, because the earphone 6 has been inserted, the electronic device 300 detects a low signal at the sense pin 116. Owing to this, the electronic device 300 supplies a voltage to a MIC_Bias terminal to check the insertion or non-insertion of a microphone. But, the voltage applied to the MIC_Bias terminal is floated because the MIC terminal 35 has not been connected with the MIC pin 115 of the ear jack 10, so the voltage supplied to the MIC_Bias terminal is applied to the SPK_L pin 112 and the sense pin 116. Due to this, the sense pin 116 receives a high signal applied and detects as if the earplug 30 is uninstalled from the ear jack 10. Accordingly, the electronic device 300 removes the voltage applied to the MIC_Bias terminal. Due to this, the sense pin 116 again receives a low signal applied and again detects as if the earplug 30 is inserted into the ear jack 10. The repetitions of the process generate a noise.

To address the aforementioned problem, in the present disclosure, when the earplug 30 is fully inserted from the loose insertion state and a low signal is sensed and, in a state where a voltage is supplied to the MIC_Bias terminal, the electronic device 300 does not turn off the MIC_Bias terminal and if a predetermined time lapses, the electronic device 300 displays an error message on the display unit 302 of the electronic device 300. Accordingly, if a user viewing this error message fully inserts the earplug 30 into the ear jack 10, the electronic device 300 determines one of a 3-pole or 4-pole of the earplug 30 based on the low voltage or high voltage applied to the MIC_Bias terminal, and performs a normal operation.

Figure 3:
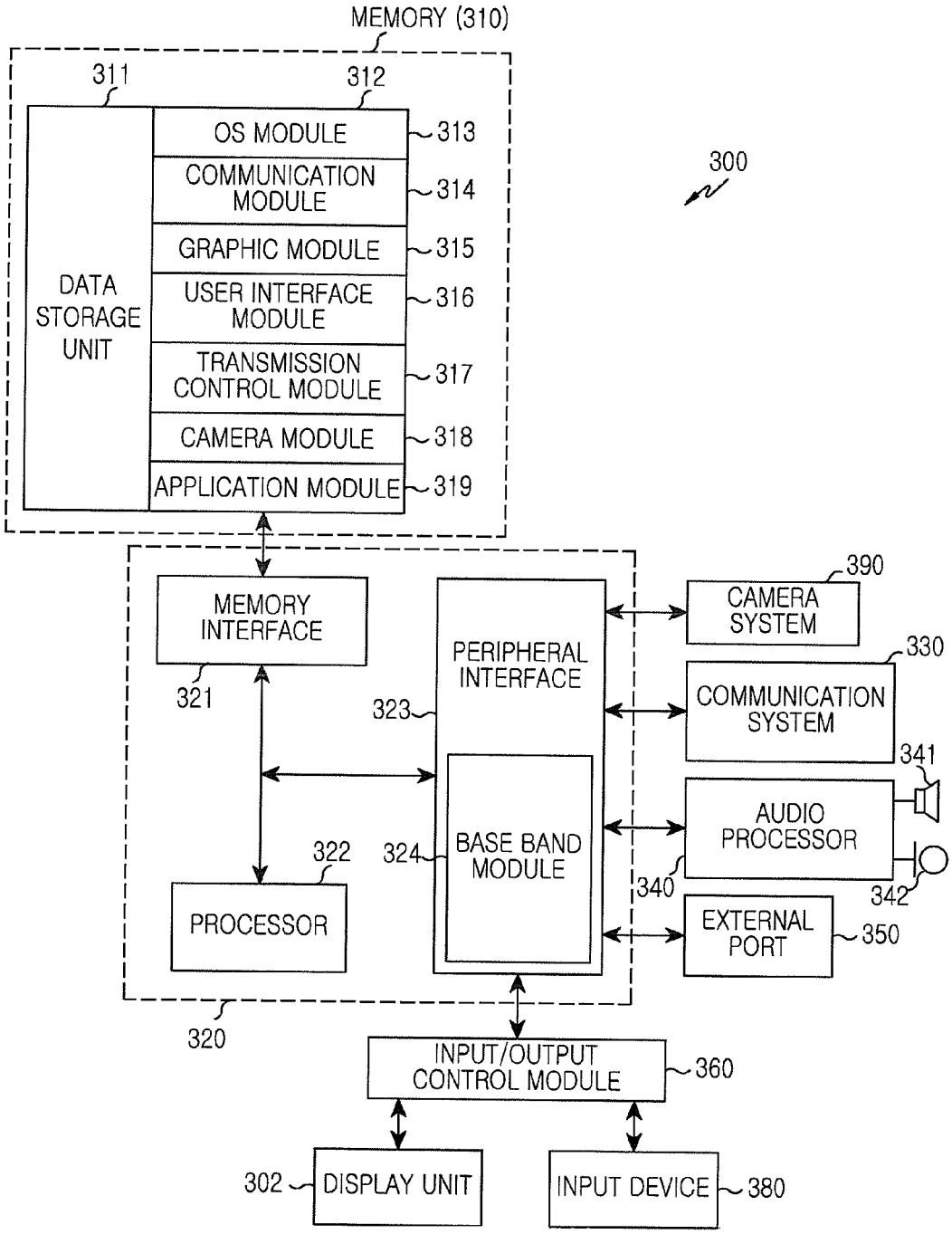
FIG. 3 is a block diagram illustrating a construction of an electronic device according to an exemplary embodiment of the present disclosure.

FIG. 3 is a block diagram illustrating a construction of an electronic device according to an exemplary embodiment of the present disclosure. Referring to FIG. 3, the electronic device includes a storage module 310, a processor unit 320, a communication system 330, an external port 350, an audio processor 340, an Input/Output (I/O) control module 360, a display unit 302, and an input device 380. Here, the storage module 310 and the external port 350 may exist in plural. The display unit 302, which is a display module, can include a display module of a touch screen scheme. Also, the external port 350 can be an ear jack 10 for electrically being connected with an earplug 30 of an earphone 6 according to one embodiment of the present disclosure. Also, the external port 350 including the ear jack 10 can include signal paths of a 3.5_DETECT terminal (denoted by reference numeral 353 in FIG. 4) to which a signal of the earplug 30 is applied and an EARMIC_P terminal (denoted by reference numeral 357 in FIG. 4) to which a MIC signal is applied.

The processor unit 320 includes a memory interface 321, a processor 322 and a peripheral interface 323. Here, the processor 321 can exist in plural. Also, the peripheral interface 323 can include a base band module 324 which receives transmission of an applied signal from the earplug 30 and in response to this, forwards a signal to a controller.

The communication system 330 can include a Radio Frequency (RF) processor and an antenna unit, although not illustrated.

The aforementioned constituent elements can be realized in hardware such as one or more integrated circuits, software, or in combination of hardware and software.

Each constituent element is described as follows.

The storage module 310 can include a data storage unit 311 and a program storage unit 312. The data storage unit 311 stores data generated during execution of a program. The program storage unit 312 stores a program for controlling an operation of the portable terminal. For example, the program storage unit 312 can include an Operating System (OS) software module 313, a communication software module 314, a graphic software module 315, a user interface software module 316, a transmission control module 317, a camera module 318, an application module 319 and the like.

The OS software module 313 includes at least one software constituent element for controlling general system operation. In an exemplary embodiment, the OS software module 313 performs a function of making smooth communication between a plurality of hardware (device) and software constituent elements.

The communication software module 314 includes at least one software constituent element for processing data that is transmitted/received through the RF processor or the external port 350. The graphic software module 315 includes at least one software constituent element for providing and displaying a graphic on the display unit 302. The user interface module 316 includes at least one software constituent element related to a user interface. The application module 319 includes a software constituent element for at least one application installed in the electronic device 300.

The transmission control module 317 includes a software constituent element for transmitting or receiving data related to the electronic device 300. The camera module 318 includes a software constituent element for general operation of a camera system 390 of the electronic device 300.

The memory interface 321 of the processor unit 320 controls the access of other constituent elements, such as the processor 322 and the peripheral interface 323, to the storage module 310. Also, the processor unit 320 analyzes a signal applied from the base band module 323 and sets a timer with a predetermined time and, if the loose insertion of the earplug 30 is sensed, the processor unit 320 controls to output an error message to the display unit 302 after the lapse of the predetermined time.

Further, if the loose insertion of the earplug 30 is sensed, the processor unit 320 controls to disconnect the voltage applied to a MIC_Bias terminal, preventing the generation of a noise resulted from a repeated connection/disconnection to the earplug 30. The processor 322 controls the electronic device 300 to provide various services such as voice communication and data communication using at least one software program. Also, the processor 322 may control to execute a software module stored in the storage module 310 and provide a multimedia service corresponding to the software module. The memory interface 321, the processor 322, and the peripheral interface 323, which are included in the processor unit 320, can be realized in a single chip or a separate chip.

The RF processor of the communication system 330 processes an RF signal transmitted/received through an antenna. For example, the RF processor includes an RF transceiver, an amplifier, a tuner, an oscillator, a Digital Signal Processor (DSP), a COding DECoding (CODEC) chip set, a Subscriber Identity Module (SIM) card and the like. The external port 350 includes a connection interface for the portable terminal to direct connect with other devices such as an earphone or connect with other devices through a network. For example, the external port 350 may include a charging interface for charging of the electronic device. The audio processor 340 forms an audio packet between a user and the electronic device 300 through a speaker 341 and a microphone 342, and provides an audio interface.

The I/O control module 360 provides interface between the display unit 302 including the display module and the input device 380 such as a key button, and the peripheral interface 323.

Figure 4:
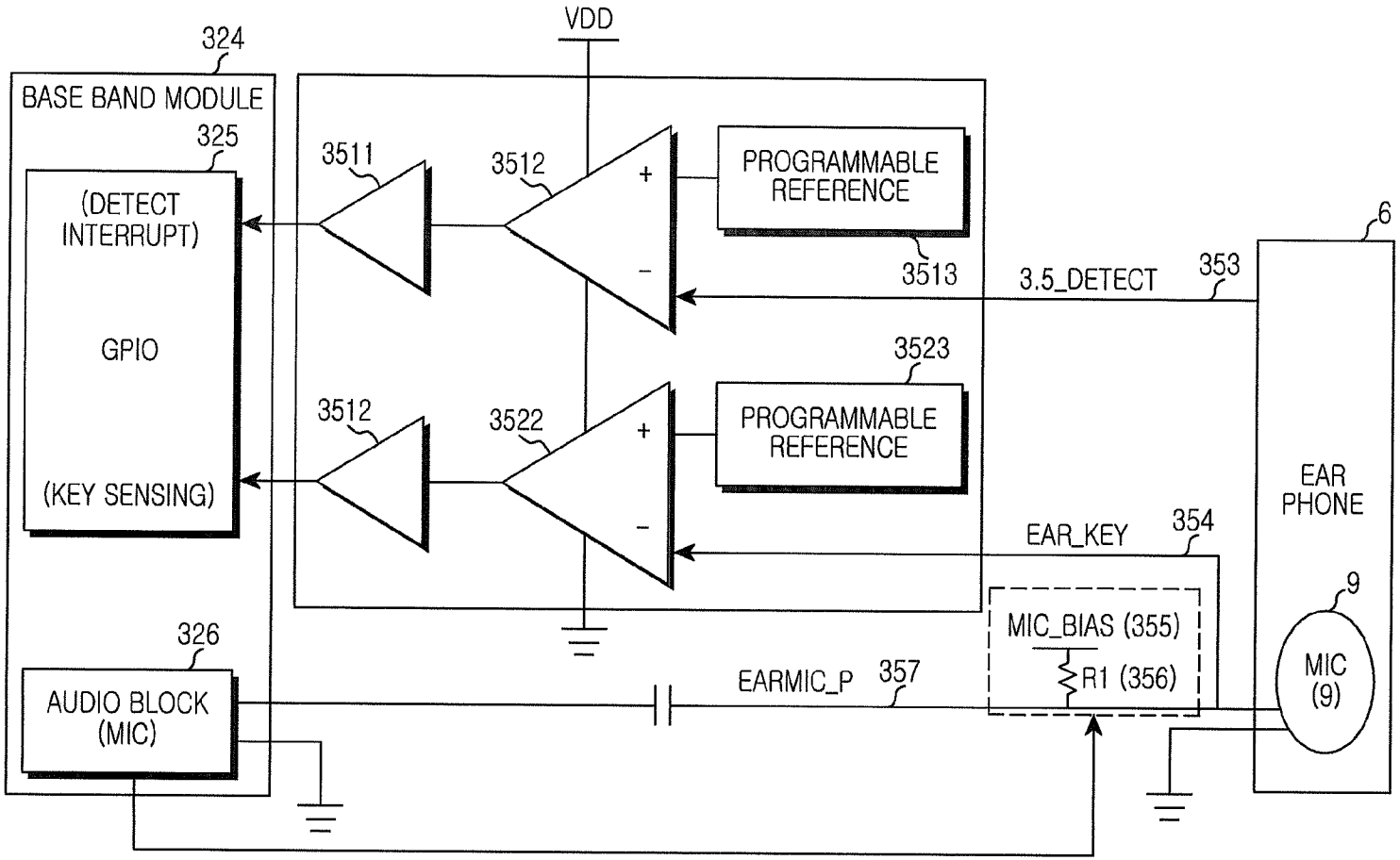
FIG. 4 is a circuit diagram illustrating an apparatus for detecting an earphone in an electronic device according to an exemplary embodiment of the present disclosure.

FIG. 4 is a high-level circuit diagram illustrating an apparatus for detecting an earphone in an electronic device according to an exemplary embodiment of the present disclosure. Referring to FIG. 4, the electronic device 300 for earphone detection includes a base band module 324 and a plurality of circuit elements for detecting an earphone 6. Here, the base band module 324 includes a General Purpose Input Output Pin (GPIO) 325 and an audio block 326. The plurality of circuit elements is described below.

First, a 3.5_DETECT terminal 353 of the electronic device 300 performs a function of providing a signal, which represents if the earphone 6 is connected to an ear jack 10, to the GPIO 325 of the base band module 324. That is, when the earphone 6 is not connected, the 3.5_DETECT terminal 353 maintains a low level and provides a voltage lower than a programmable reference voltage 3513 to a first comparator 3512. In contrast, when the earphone 6 is connected, the 3.5_DETECT terminal 353 maintains a high level and provides a voltage higher than the programmable reference voltage 3513 to the first comparator 3512. Here, the programmable reference voltage 3513 of the first comparator 3512 is set by a developer.

When the earphone 6 is not connected, the first comparator 3512 receives an input of the voltage lower than the programmable reference voltage 3513 from the 3.5_DETECT terminal 353, and outputs a low signal to a first inverter 3511. In contrast, when the earphone 6 is connected, the first comparator 3512 receives an input of the voltage higher than the programmable reference voltage 3513 from the 3.5_DETECT terminal 353, and outputs a high signal to the first inverter 3511.

The first inverter 3511 inverts a high signal input from the first comparator 3512 to a low signal or inverts a low signal from the first comparator 3512 to a high signal to output the high signal or low signal to the GPIO 325 of the base band module 324. That is, when the earphone 6 is not connected, the first inverter 3511 receives an input of a low signal from the first comparator 3512, inverts the low signal to a high signal, and outputs the high signal to the GPIO 325. In contrast, when the earphone 6 is connected, the first inverter 3511 receives an input of a high signal from the first comparator 3152, inverts the high signal to a low signal, and outputs the low signal to the GPIO 325.

The GPIO 325 of the base band module 324 determines if the earphone 6 is connected using a signal input from the first inverter 3511. That is, when a high signal is input from the first inverter 3511, the GPIO 325 determines that the earphone 6 has not been connected. In contrast, when a low signal is input from the first inverter 3511, the GPIO 325 determines that the earphone 6 has been connected.

Also, the GPIO 325 determines if the earphone 6 connected to the electronic device 300 is a 3-pole earphone or a 4-pole earphone using a signal input from the 2nd inverter 3521. When the earphone 6 is the 4-pole earphone, the GPIO 325 processes a function for sensing if a SEND/END key is input and performing a corresponding operation.

When the 3-pole earphone is connected, the second comparator 3522 receives an input of a voltage lower than a programmable reference voltage 3523 from an EAR_KEY terminal 354, and outputs a low signal to a 2nd inverter 3521. In contrast, when the 4-pole earphone is connected, the second comparator 3522 receives an input of a voltage higher than the programmable reference voltage 3523 from the EAR_KEY terminal 354, and outputs a high signal to the second inverter 3521. Here, the programmable reference voltage 3523 is set by the developer. Also, when a SEND/END key of the 4-pole earphone is input, the second comparator 3522 receives an input of a voltage lower than the programmable reference voltage 3523 from the EAR_KEY terminal 354, and outputs a low signal to the 2nd inverter 3521.

The 2nd inverter 3521 inverts a high signal input from the second comparator 3522 to a low signal or inverts a low signal input from the second comparator 3522 to a high signal to output the low signal or the high signal to the GPIO 325 of the base band module 324.

That is, in a state where a low signal is input from the first inverter 3511, when a high signal is input from the second inverter 3521, the GPIO 325 determines that the 3-pole earphone has been connected. In contrast, in the state where the low signal is input from the first inverter 3511, when a low signal is input from the 2nd inverter 3521, the GPIO 325 determines that the O-pole earphone has been connected. Here, when it is determined that the 4-pole earphone has been connected through the first inverter 3511 and the second inverter 3521, if a low signal from the second inverter 3521 is changed to a high level and then is changed to a low level, the GPIO 325 determines that a SEND/END key of the 4-pole earphone has been input, and performs a switching function for operating the audio block 326.

Also, the audio block 326 of the base band module 324 receives a microphone signal from the earphone 6 of the electronic device 300 through the EARMIC_P terminal 357, and processes the microphone signal.

When the 4-pole earphone is connected and the SEND/END key of the 4-pole earphone is input, the EARMIC_P terminal 357 receives a user voice signal from the 4-pole earphone and provides the voice signal to the audio block 326.

Also, when the earplug 30 is loosely inserted into the ear jack 10 and the 3.5 DETECT terminal 353 is inverted from a low level to a high level, the base band module 324 does not turn off the voltage applied and continues to apply it to a MIC_BIAS terminal 355 under control of the processor unit 320. Also, from this point, the processor unit 320 set a timer with a predetermined time and, if a predetermined time lapses, the processor unit 320 outputs an error message resulted from the loose insertion of the earplug 30, to a display unit 320 of the electronic device 300.

The aforementioned earphone detection process in the electronic device is described below in detail.

Figure 5:
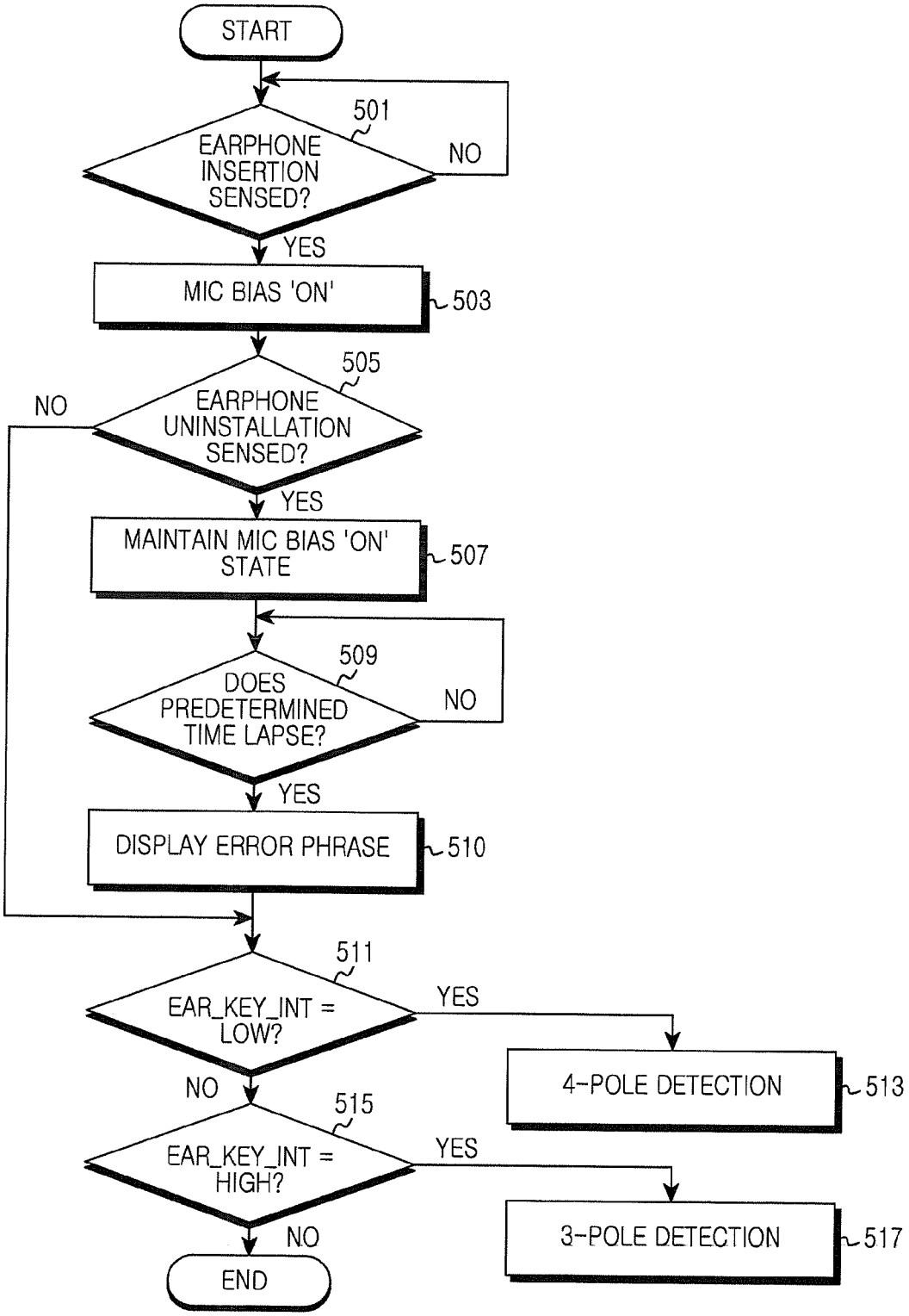
FIG. 5 is a flowchart illustrating a method for detecting an earphone in an electronic device according to an exemplary embodiment of the present disclosure.
Figure 7:
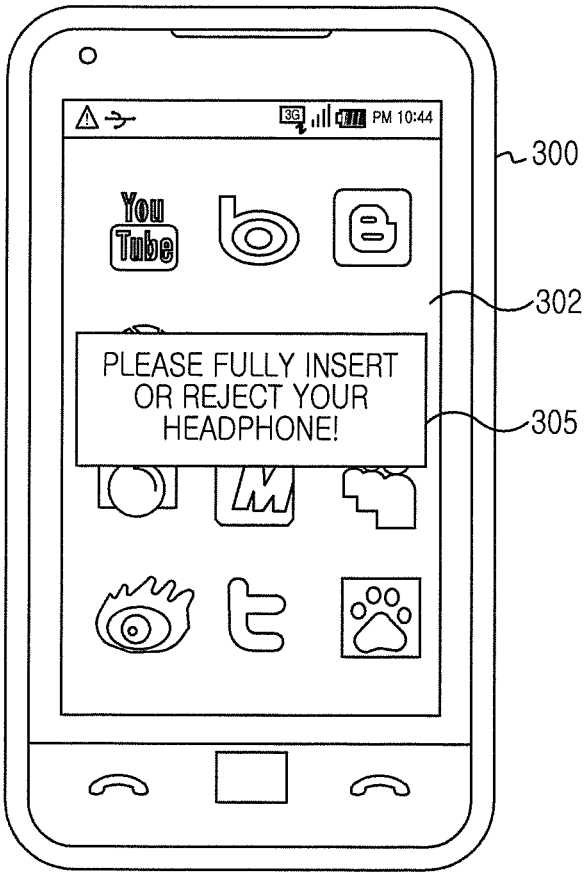
FIG. 7 is a diagram illustrating a scene for informing a user of a state in which an earplug of an earphone is loosely inserted in an electronic device according to an exemplary embodiment of the present disclosure.

FIG. 5 is a flowchart illustrating a method for detecting an earphone in an electronic device according to an exemplary embodiment of the present disclosure. FIG. 6 is a diagram illustrating a normal operation code resulting from earphone detection of the electronic device according to one exemplary embodiment of the present disclosure and an erroneous operation code resulting from conventional loose insertion. FIG. 7 is a diagram illustrating a scene for informing a user of a state in which an earplug of the earphone is loosely inserted in the electronic device according to the exemplary embodiment of the present disclosure.

The method for detecting the earphone in the electronic device according to the present disclosure is described as follows.

First, in step 501, the electronic device checks if an earphone has been inserted. If it is checked in step 501 that the earphone has been inserted, in step 503, the electronic device applies a predetermined voltage to a MIC_Bias terminal so as to check if an inserted earplug is a 3-pole terminal or a 4-pole terminal. In an exemplary embodiment, when the earphone has not been connected, the electronic device provides a high signal to a base band module and, when the earphone has been connected, the electronic device provides a low signal to the base band module, whereby a processor unit can sense a connection state of the earphone.

After that, in step 505, the electronic device checks if the earphone has been again uninstalled. That is, when it is checked that, owing to the loose insertion of the earplug, a GND terminal is floated, the voltage applied to the MIC_Bias terminal is applied to a 3.5 DETECT terminal, and a high signal is provided to the base band module, the processor unit proceeds to step 507 and does not turn off the voltage applied to the MIC_Bias terminal and maintains a state thereof. Simultaneously, the electronic device drives a timer. Accordingly, by not turning off the voltage applied to the MIC_Bias terminal as above, the processor unit can perform a normal operation as illustrated in FIG. 6B unlike FIG. 6A.

Next, if a predetermined time lapses in step 509, the processor unit displays an error message on a display unit 302 of the electronic device 300 in step 510. For example, the error message can be a message 305, "Please fully insert or reject your headphone" on the display unit 302 of the electronic device 300 as illustrated in FIG. 7.

In contrast, after the error message is displayed, if a user fully inserts the earplug of the earphone into the ear jack 10 of the electronic device 300, in step 511, the processor unit checks if an EAR_KEY_INT terminal is changed to a low level. If it is checked in step 511 that EAR_KEY_INT terminal is changed to the low level, the processor unit proceeds to step 513 and detects as the earphone has a 4-pole earplug. If it is checked in step 515 that the EAR_KEY_INT terminal is changed to a high level, the processor unit proceeds to step 517 and detects as the earphone has a 3-pole earplug.

Although not illustrated, if a user fully removes the earplug from the ear jack after detects the error message, a MIC terminal comes into contacts with a GND terminal of the ear jack during the removal and a voltage applied to the MIC_Bias terminal drops, whereby the separation of the ear jack can be detected.

According to the present disclosure, there is an effect of, although an earplug of an earphone is loosely inserted into an ear jack of an electronic device, being able to preventing the generation of a noise and, by previously notifying a user of this state, being able to increase a convenience of use of the electronic device.

While the disclosure has been shown and described with reference to certain preferred embodiments thereof, it will be understood by those skilled in the art that various changes in form and details may be made therein without departing from the spirit and scope of the invention as defined by the appended claims.

What is claimed is:

1. An electronic device to interact with an earphone, the electronic device comprising:

an external port configured to receive a plug of an earphone; and at least one processor configured to:

control an application of a voltage to a MIC_BIAS terminal of the electronic device when an insertion of the plug into the external port is sensed by the electronic device, detect that the inserted plug is loose in the external port by sensing periodic signal changes of a sensed pin associated with an installation or an uninstallation of the plug, and in response to detecting that the plug is loose in the external port, provide a notification of the detected loose plug to prevent a generation of a noise from the MIC_BIAS terminal caused by an application of a periodic voltage resulting from the loose plug.

2. The electronic device of claim 1, further comprising a notification device configured to notify a user of the loose plug in the external port through the processor.

3. The electronic device of claim 2, wherein the notification device comprises a display unit configured to display an error message indicating that the plug is loose in the external port to the user through the processor.

4. The electronic device of claim 2, wherein the notification device comprises an audio output device configured to generate a sound to the user of the loose plug in the external port through the processor.

5. The electronic device of claim 2, wherein the processor is configured to:

set a timer with a predetermined time when a disconnection of the plug is sensed, and activate the notification device to notify the user when the predetermined time has expired.

6. The electronic device of claim 5, wherein after activating the notification device, the processor is configured to release the notification device in response to one of a lapse of the predetermined time, a sensing of a manipulation of a key on the electronic device, and a sensing of a normal installation of the plug into the external port or an uninstallation of the plug from the external port.

7. The electronic device of claim 1, wherein the at least one processor configured to control the application of the voltage to the MIC_BIAS terminal of the electronic device to determine whether the plug is a 3-pole terminal or a 4-pole terminal.

8. The electronic device of claim 7, wherein the electronic device determines whether the plug is the 3-pole terminal or the 4-pole terminal based on a low voltage or a high voltage applied to the MIC_BIAS terminal.

9. The electronic device of claim 1, wherein the periodic signal changes of the sensed pin associated with an installation or an uninstallation comprise changing from a low signal to a high signal when the sensed pin changes to an uninstalled position and changing from the high signal to the low signal when the sensed pin changes to an installed position.

10. The electronic device of claim 1, wherein the electronic device comprises at least one of a Personal Digital Assistant (PDA), a laptop computer, a smart phone, a netbook, a Mobile Internet Device (MID), a Ultra Mobile Personal Computer (UMPC), a table PC, a navigator, or an MPEG audio layer 3 (MP3) player.

11. A method using an electronic device to interact with an earphone, the method comprising:

applying a voltage to an MIC_BIAS terminal in response to sensing an insertion of a plug of the earphone into an external port;

detecting that the inserted plug is loose in the external port by sensing periodic signal changes of a sensed pin associated with an installation or an uninstallation of the plug; and in response to detecting that the plug is loose in the external port, providing a notification of the detected loose plug to prevent a generation of a noise from the MIC_BIAS terminal caused by an application of a periodic voltage resulting from the loose plug.

12. The method of claim 11, further comprising:

setting a timer with a predetermined time when a disconnection of the plug is sensed; and activating a notification device when the predetermined time expires.

13. The method of claim 12, wherein activating the notification device comprises displaying an error message on a display unit that indicates the loose plug in the external port.

14. The method of claim 12, wherein activating the notification device comprises activating an audio output device to notify a user of the loose plug in the external port using an audible signal.

15. The method of claim 12, further comprising:

after the notification device is activated, deactivating the notification device in response to one of: a lapse of the predetermined time, a sensing of a manipulation of a key on the electronic device, and a sensing of a normal installation of the plug into the external port or an uninstallation of the plug from the external port.

16. The method of claim 11, wherein the voltage is applied to the MIC_BIAS terminal of the electronic device to determine whether the plug is a 3-pole terminal or a 4-pole terminal.

17. The method of claim 16, wherein the electronic device determines whether the plug is the 3-pole terminal or the 4-pole terminal based on a low voltage or a high voltage applied to the MIC_BIAS terminal.

18. The method of claim 11, wherein the periodic signal changes of the sensed pin associated with an installation or an uninstallation comprise changing from a low signal to a high signal when the sensed pin changes to an uninstalled position and changing from the high signal to the low signal when the sensed pin changes to an installed position.

19. The method of claim 11, wherein when the predetermined time lapses, displaying an error message on a display unit of the electronic device.

20. The method of claim 11, wherein the electronic device comprises at least one of a Personal Digital Assistant (PDA), a laptop computer, a smart phone, a netbook, a Mobile Internet Device (MID), a Ultra Mobile Personal Computer (UMPC), a table PC, a navigator, or an MPEG audio layer 3 (MP3) player.

* * * * *